United States Patent [19]

Roy et al.

[11] Patent Number: 5,042,758

[45] Date of Patent: Aug. 27, 1991

[54] NURSING BOTTLE HOLDER

[76] Inventors: William C. Roy; Judith A. Roy, both of 1548 D Apache Dr., Chula Vista, Calif. 92010; Russell C. Edmisson, 329 Poinsettia Ave., Corona del Mar, Calif. 92625

[21] Appl. No.: 581,802

[22] Filed: Sep. 13, 1990

Related U.S. Application Data

[63] Continuation-in-part of Ser. No. 420,590, Oct. 12, 1989, and a continuation-in-part of Ser. No. 209,308, Jun. 21, 1988, abandoned, and a continuation-in-part of Ser. No. 280,250, Dec. 5, 1988.

[51] Int. Cl.[5] ..... A47D 15/00

[52] U.S. Cl. ..... 248/104

[58] Field of Search ..... 248/102–106, 248/215, 278, 304, 305, 308, 339; 403/105

[56] References Cited

U.S. PATENT DOCUMENTS

| | | | |
|---|---|---|---|
| 753,683 | 3/1904 | Dixon | 248/103 |
| 1,220,266 | 3/1917 | Ott | 248/103 |
| 1,688,765 | 10/1928 | Veras | 248/103 |
| 1,753,875 | 4/1930 | Baumann | 248/103 |
| 1,900,691 | 3/1933 | Carlson | 248/102 |
| 2,448,189 | 8/1948 | Mott | 248/104 |
| 2,470,694 | 5/1949 | Foo | 248/106 |
| 2,490,158 | 12/1949 | Reynolds | 248/103 |
| 2,500,471 | 3/1950 | Schmiedt | 248/308 |
| 2,500,846 | 3/1950 | McFarland | 248/102 |
| 2,638,296 | 5/1953 | Battle | 248/105 |
| 2,842,822 | 7/1958 | Bennett | 248/308 |
| 2,893,672 | 7/1959 | Vardan | 248/102 |
| 2,907,539 | 10/1959 | Vardan | 248/106 |
| 2,909,345 | 10/1959 | Matsuoka | 248/106 |
| 2,938,693 | 5/1960 | Vardan | 248/104 |
| 3,016,221 | 1/1962 | Underwood | 248/102 |
| 3,144,230 | 8/1964 | Brooks | 248/102 |
| 3,197,099 | 7/1965 | Doba | 248/102 |
| 3,222,020 | 12/1965 | Rea | 248/106 |
| 3,289,986 | 12/1966 | Martin | 248/103 |
| 3,627,244 | 12/1971 | Nicholas | 248/103 |
| 3,977,638 | 8/1976 | Woodard | 248/102 |
| 4,498,613 | 1/1985 | Donahue | 248/102 |
| 4,537,341 | 8/1985 | Kelly | 248/104 |

*Primary Examiner*—Ramon O. Ramirez
*Assistant Examiner*—Robert A. Olson
*Attorney, Agent, or Firm*—Henri J. A. Charmasson

[57] ABSTRACT

A nursing bottle support for freeing the hands of a person carrying an infant while feeding the infant from the bottle comprises a foldable, non-resilient hook which wraps around the person's neck with an adjustable shank lying against the person's chest. A clasp made of an open-ring of elastomeric material is rotatably mounted at the end of the shank, and can be positioned in a variety of orientations to direct the bottle toward the mouth of the feeding infant.

5 Claims, 1 Drawing Sheet

NURSING BOTTLE HOLDER

PRIOR APPLICATIONS

This application is a continuation-in-part of Ser. No. 07/420,590 filed Oct. 12, 1989, a continuation-in-part of Ser. No. 07/209,308 filed June 21, 1988 now abandoned, and of Ser. No. 07/280,250 filed Dec. 5, 1988.

BACKGROUND OF THE INVENTION

This invention relates to slings and more particularly to nursing bottle holders adapted to be suspended from the neck of a person holding an infant for feeding purpose.

Such an nursing bottle holder should be quickly adjustable to a variety of wearer sizes and body shapes as well as to a variety of infant positions. More significantly, the nursing bottle holder must not have any hard or sharp parts that could injure the infant, or any component that could come loose and be swallowed by him. It should be simply in construction and easy to clean or even sterilize. To that effect the nursing bottle holder should be submersible, and should withstand sterilizing temperatures. The prior art disclosed numerous attempts at meeting those requirements. Most structures of the prior art use sharp metal components such as booms, clamps, brackets, springs, and clips which could be injurious to the infant. Other prior structures include complex harnesses which are cumbersome to install, and offer only limited adjustability. Yet, others because of their size and multiplicity of building materials could not be easily and effectively cleaned or sterilized.

SUMMARY OF THE INVENTION

The principal and secondary objects of the invention is to provide a nursing bottle holder which can be quickly adapted to the particular body features of the wearer, can be quickly put on and taken off, is entirely made of soft material with no hard or sharp components that could injure the infant or come loose and be swallowed by him, and can be cleaned or sterilized by immersion into boiling water.

These and other objects are achieved by means of a nursing bottle holder which has an articulated but non-resilient neck-piece in the form of the open loop of a hook with a bellows-type expandable shank into which a bottle clasp made of elastomeric material is rotatably plugged. The clasp itself may be an open loop which can be opened or stretched to grasp a nursing bottle. It is the resiliency of the clasp itself in the absence of any metallic spring or clip which provides a stable and safe way to hold and orient the bottle to the most comfortable position for both the wearer and the infant.

DESCRIPTION OF THE PREFERRED EMBODIMENT OF THE INVENTION

Figure 1:
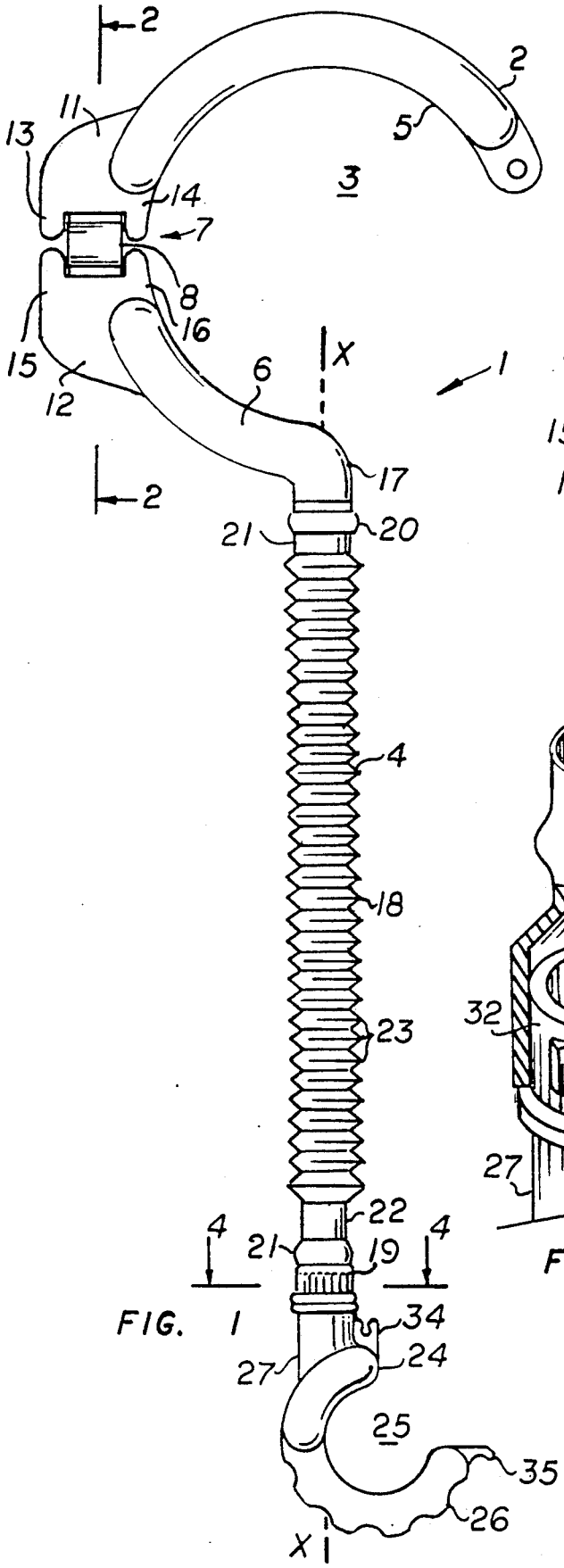
FIG. 1 is a front elevational view of a nursing bottle support.

Referring now to the drawing, there is shown a nursing bottle support 1 which is designed to be worn by a person holding an infant, and to support a nursing bottle in a feeding position in order to free at least one of the person's hands.

Figure 2:
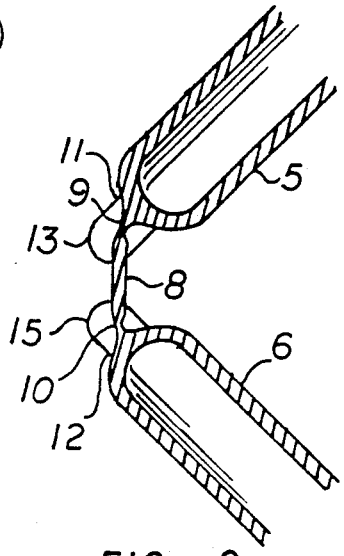
FIG. 2 is a detail cross-sectional view of the collar articulation taken along line 2—2 of FIG. 1.
Figure 3:
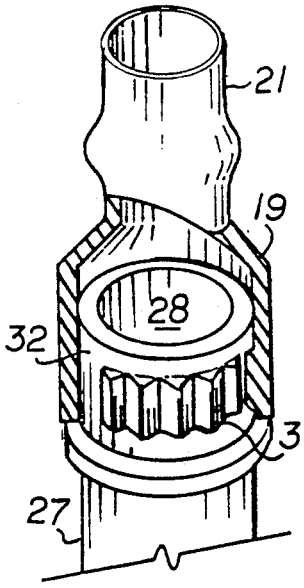
FIG. 3 is a detail view of the shank and clasp connecting assembly.

The support comprises a hook 2 which defines an open loop 3 shaped and dimensioned to fit around the neck of the person, and a shank 4 sized to hang against the person's chest. The hook 2 is made of two arcuate, tubular sections 5 and 6 articulately joined by a flexible link 7. The entire hook is made of molded polypropelene. The flexible link 7 which is best illustrated by FIG. 2 comprises a solid bead 8 with flexible web segments 9–10 extending from opposite ends into gussets 11 and 12 at the closed ends of the tubular sections 5 and 6 respectively. The gussets have projections 13, 14 and 15, 16 that extend along the side of the webs and bead to protect the webs against shearing by lateral impacts and to limit lateral bending of the flexible link assembly 7. The two hook sections 5, 6, the beads 8, the web segments 9, 10, and gussets 11, 12 are all integrally formed in a single molding process.

The shank 4 comprises three elements, the connecting elbow 17 of the hook 2, an expandable segment 18 and the lower end-piece 19.

The expandable and bendable segment 18 comprises a tube of flexible material such as plastic, the wall of which has been molded to form bellows. The bellows consist of a succession of accordion-type folds which generally lies in planes orthogonal to the axis X—X of the shank 4. This type of bellowed structure is well known to the art and has been disclosed in U.S. Pat. No. 3,929,165 Diebolt et al. among others. The connecting elbow 17 of the hook is terminated by an enlarged annular section 20 which is captured by the upper neck 21 of the expandable element 18. The end-piece 19 has a similar section 21 which is engaged by the lower end-collar 22 of the expandable segment 18. The expandable element 18 is shown in its near fully extended position in FIG. 1, but can be collapsed, to half of its extended length or to any discrete position therebetween by selectively folding any one or number of discrete folds 23 of the bellows.

Figure 4:
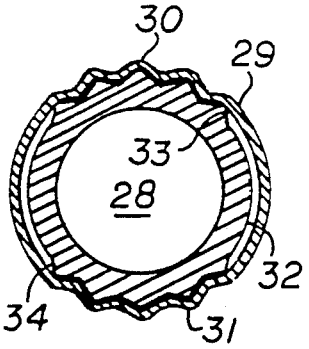
FIG. 4 is a cross-sectional view of the clasp positioning detent mechanisms taken along line 4—4 of FIG. 1.

A feeding bottle holding clasp 24 is rotatably attached to the end-piece 19. This clasp is made from a soft elastomeric material, and defines an open loop 25 whose inner dimensions are slightly smaller than the outer diameter of the feeding bottle. The semi-circular end portion 26 of the open loop is thinned for added flexibility, so that it can be easily bent to increase the open loop 25 through which the bottle can be inserted. A small hook 35 and an eyelet 34 at opposite ends of the loop opening may be used to hold a rubber-band or other cinching member to close the loop around a nursing bottle. A shaft 27 projecting from the side of the clasp 24 is captured by an axial bore 28 in the tip of the end-piece 19. Thus, once the bottle is set in the clasp 24 it can be oriented in a variety of directions by rotating the clasp within the bore 28. The height of the bottle can be varied by expanding or collapsing the expandable element 18, and the general position of the nursing bottle support can be easily adjusted by bending the expandable element to obtain the most stable and the most comfortable position. As shown in FIG. 4, the lower rim 29 of the end piece 19 has diametrically opposite series of inner indentations 30 and 31. The upper neck 32 of the clasp projections 27 has two sets 33 and 34 of indentations along its outer periphery which are symmetrically matching and meshing with the end pieces indentation. These meshing sets of indentations act as detent positions to set and hold the clasp 24 in a plurality of radial positions in relation to the rest of the device. Since the entire clasp assembly is made from elastomeric material it can be pulled out from its mounting bore 28 for cleaning purpose and reinstalled by forcing the end 32 of the projection 27 through the bore 28. The nursing bottle support 1 provides a practical and safe device for freeing at least one hand of a person trying to feed an infant being carried. There are no exposed metallic or sharp components that could injure the infant and the only piece that could come apart, the clasp 24 is too large to be swallowed by the infant and could safely be used as a teething ring.

While the preferred embodiment of an alternate configuration has been described, modification could be made and other embodiments could be devised without departing from the spirit of the invention and the scope of the appended claims.

What is claimed is:

1. A nursing bottle support for freeing the hands of a infant-carrying person, which comprises:

a flexible, non-resilient hook forming an open loop shaped and dimensioned to engage the neck of the person, and terminating into a generally straight shank sized to hang against the person's chest;

a resiliently adjustable clasp sized to fit around a nursing bottle;

a multi-directionally orientable means for attaching the clasp to the shank of the hook; and wherein means on the outer periphery of said clasp for rotatably connecting the clasp to the shank of the hook; and said hook comprises:

two substantially symmetrical arcuate sections; and a pliable web integrally joined at opposite ends to said arcuate sections.

2. The nursing bottle support of claim 1, wherein said shank comprises an expandable tubular section.

3. The nursing bottle support of claim 2, wherein said expandable section comprises a tube of flexible material coaxial with the shank, and having its wall molded to define a series of circular accordion folds generally normal to the axis of the shank.

4. The nursing bottle support of claim 3, wherein the shank comprises an end-piece attached to said clasp.

5. The nursing bottle support of claim 4, wherein said means for attaching comprises a prong extending from the outer surface of said clasp;

said end-piece having a bore shaped and dimensioned to rotatably engage said prong; and a first series of indentations on the outer periphery of said prong and a second series of indentations on the inner side surface of said bore detentably meshing with said first series.

* * * * *